US008443883B2

(12) United States Patent
Peter et al.

(10) Patent No.: US 8,443,883 B2
(45) Date of Patent: May 21, 2013

(54) APPARATUS AND METHOD FOR DETECTING POOR HOLE CLEANING AND STUCK PIPE

(75) Inventors: Andreas Peter, Niedersachsen (DE); Rene N. Ritter, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 335 days.

(21) Appl. No.: 12/508,094

(22) Filed: Jul. 23, 2009

(65) Prior Publication Data

US 2010/0018701 A1 Jan. 28, 2010

Related U.S. Application Data

(60) Provisional application No. 61/084,039, filed on Jul. 28, 2008.

(51) Int. Cl.
*E21B 47/00* (2012.01)
*E21B 44/00* (2006.01)

(52) U.S. Cl.
USPC ..... 166/250.01; 166/250.13; 175/40; 73/152.48

(58) Field of Classification Search
USPC .. 166/250.01, 250.13, 66; 175/40; 73/152.47, 73/152.48
See application file for complete search history.

(56) References Cited

U.S. PATENT DOCUMENTS

| | | | | |
|---|---|---|---|---|
| 3,417,827 | A * | 12/1968 | Smith et al. | 175/4.52 |
| 5,354,956 | A * | 10/1994 | Orban et al. | 181/105 |
| 5,448,911 | A | 9/1995 | Mason | |
| 5,660,239 | A | 8/1997 | Mueller | |
| 6,401,838 | B1 | 6/2002 | Rezmer-Cooper | |
| 7,114,579 | B2 | 10/2006 | Hutchinson | |
| 7,168,311 | B2 * | 1/2007 | Zisk et al. | 73/152.31 |
| 7,207,396 | B2 | 4/2007 | Hall et al. | |
| 2005/0200498 | A1 * | 9/2005 | Gleitman | 340/854.4 |
| 2006/0107772 | A1 * | 5/2006 | Shinn et al. | 73/864.43 |

OTHER PUBLICATIONS

Yarim, et al. "Stuck Pipe Prevention—A Proactive Solution to an Old Problem". SPE 109914. Presentation at the 2007 SPE Annual Technical Conference and Exhibition held in Anaheim, California, USA Nov. 11-14, 2007.

Haduch, et al. "Solution of Common Stuck Pipe Problems Through the Adaptation of Torque/Drag Calculations". IADC/SPE 27490. Presentation at the 1994 IADC/SPE Drilling Conference held in Dallas, Texas, Feb. 15-18, 1994.

* cited by examiner

*Primary Examiner* — Brad Harcourt
(74) *Attorney, Agent, or Firm* — Cantor Colburn LLP

(57) ABSTRACT

A method for preventing a downhole tool from getting stuck in a wellbore, includes: monitoring output of at least one friction sensor mounted on an external surface of the downhole tool; and if the output indicates a high friction condition, then reducing the friction to prevent the tool from getting stuck. A tool and a computer program product are provided.

23 Claims, 5 Drawing Sheets

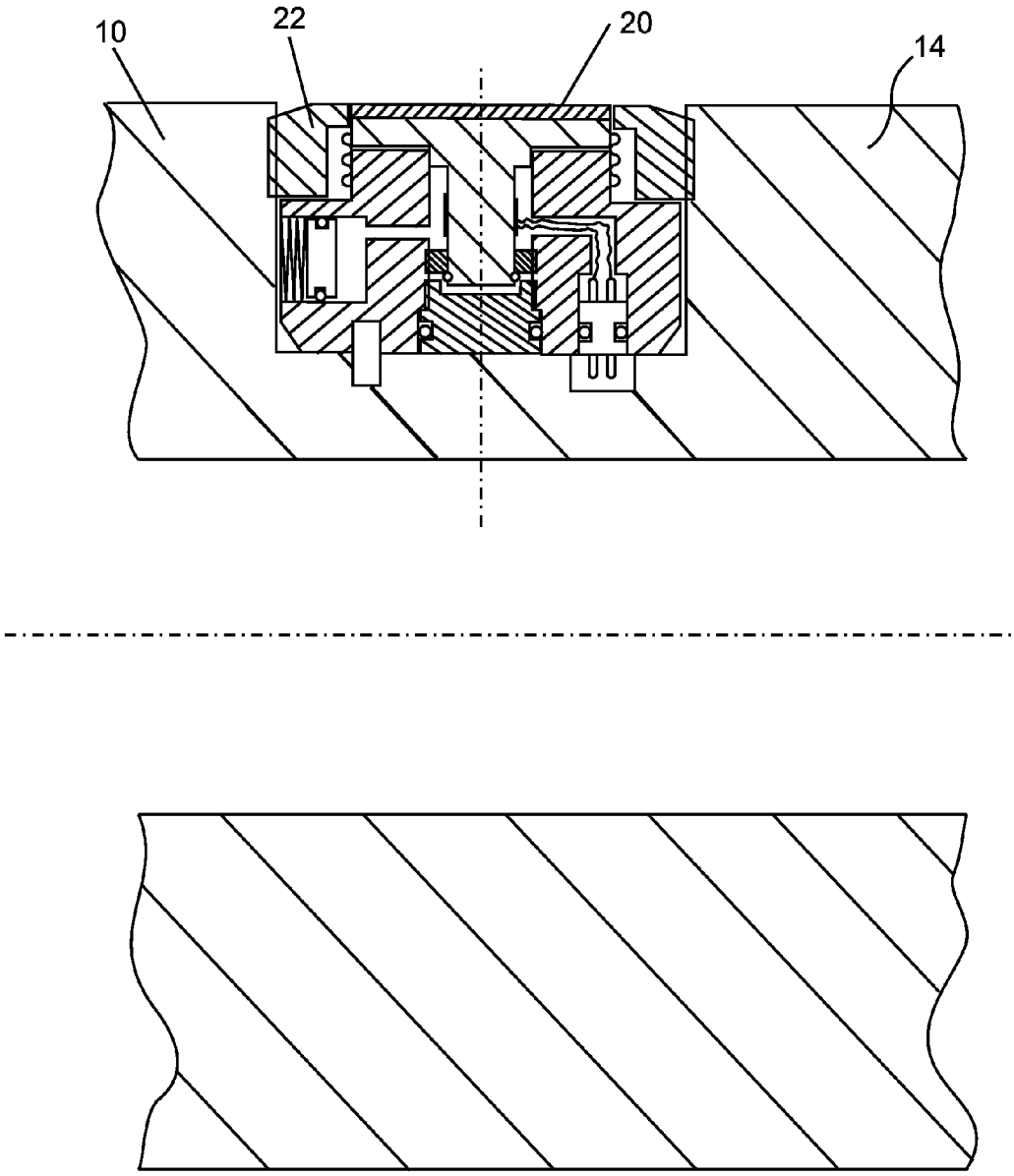
FIG. 2
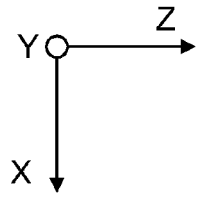

APPARATUS AND METHOD FOR DETECTING POOR HOLE CLEANING AND STUCK PIPE

CROSS-REFERENCE TO RELATED APPLICATIONS

This application claims the benefit of U.S. Provisional Application Ser. No. 61/084,039, entitled "Apparatus And Method For Detecting Poor Hole Cleaning And Stuck Pipe", filed Jul. 28, 2008, which is incorporated herein by reference in its entirety.

BACKGROUND OF THE INVENTION

1. Field of the Invention

The invention disclosed herein relates to oil field exploration and, in particular, to detection of friction between instrumentation downhole and the surrounding environment.

2. Description of the Related Art

One of the most severe problems that can occur when drilling a hole into the ground, for example a hydrocarbon exploration well, is the inability to remove the drill string from the borehole. There are many possible reasons for such an event. Two very common reasons are insufficient hole cleaning and swelling formation. When the mud circulation is inappropriate, it is not capable of carrying all cuttings to surface. Over time, the cuttings accumulate in the annulus between the drill string and the borehole wall. Increasing friction between the drill string and the cuttings eventually exceeds the available torque and pull force, and the string becomes stuck. Some formations will slowly decrease the borehole diameter (e.g. due to reactions with the drilling mud or due to insufficient strength). The reduced borehole diameter increases the friction acting upon the drill string, in some cases up to a point where the torque and pulling capacity of the drilling rig is exceeded, and the string becomes stuck.

In the prior art approaches were taken to address stuck strings. As an example, some solutions tried to predict such events by monitoring the circulating pressure, the drilling torque or the vibration characteristics of the drill string or the Bottom Hole Assembly (BHA). The drilling torque and the changing vibration characteristics are effects caused by increasing friction. Measuring the friction itself provides a more direct knowledge of the situation, facilitating the prevention of a stuck pipe event.

Therefore, what are needed are methods and apparatus that help to prevent stuck pipe resulting from poor hole cleaning or swelling formation. Preferably, the methods and apparatus provide for measuring frictional forces in play on an exterior surface of the pipe.

BRIEF SUMMARY OF THE INVENTION

An embodiment of the invention includes a method for preventing a downhole tool from getting stuck in a wellbore, the method including: monitoring output of at least one friction sensor mounted on an external surface of the downhole tool; and if the output indicates a high friction condition, then reducing the friction to prevent the tool from getting stuck.

Another embodiment of the invention includes a tool, including: at least one friction sensor mounted on an outer surface of the tool, the friction sensor including a component for converting mechanical stress arising from friction between the tool and the surrounding formation into an electrical signal.

A further embodiment of the invention includes a computer program product including machine readable instructions stored on machine readable media, the instructions for notifying a user of friction on a downhole tool, by implementing a method including: receiving output from at least one friction sensor; and notifying the user of the friction sensed.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

FIG. 2 provides a cross sectional view of the drill string and a friction sensor;

DETAILED DESCRIPTION OF THE INVENTION

Disclosed are methods and apparatus for detecting situations that may cause a stuck pipe or drill. The methods and apparatus provide users with adequate warning, such that defensive measures may be taken, and thus problems associated with stuck equipment are avoided.

As an overview, disclosed herein is a friction sensing element for detecting friction between downhole equipment and the surrounding environment. Although disclosed herein in terms of use with a drill string, it should be recognized that the sensor may be used with most, if not all, downhole tools or instruments.

In the example having the sensor mounted on a tubular outer surface of a drill string, the sensor is used to detect increasing amounts of friction. The sensor may also be used to detect increases in the extent of the drill string that is in frictional contact with the surrounding environment. Using the sensor, an early warning can be sent to users on the surface and counter measures may be initiated, thus saving expensive equipment and avoiding lost time.

In some embodiments, multiple sensors are used. As an example, the sensors may be distributed over the length of the drill string (e.g. in the repeater subs of a wired pipe network).

Figure 1:
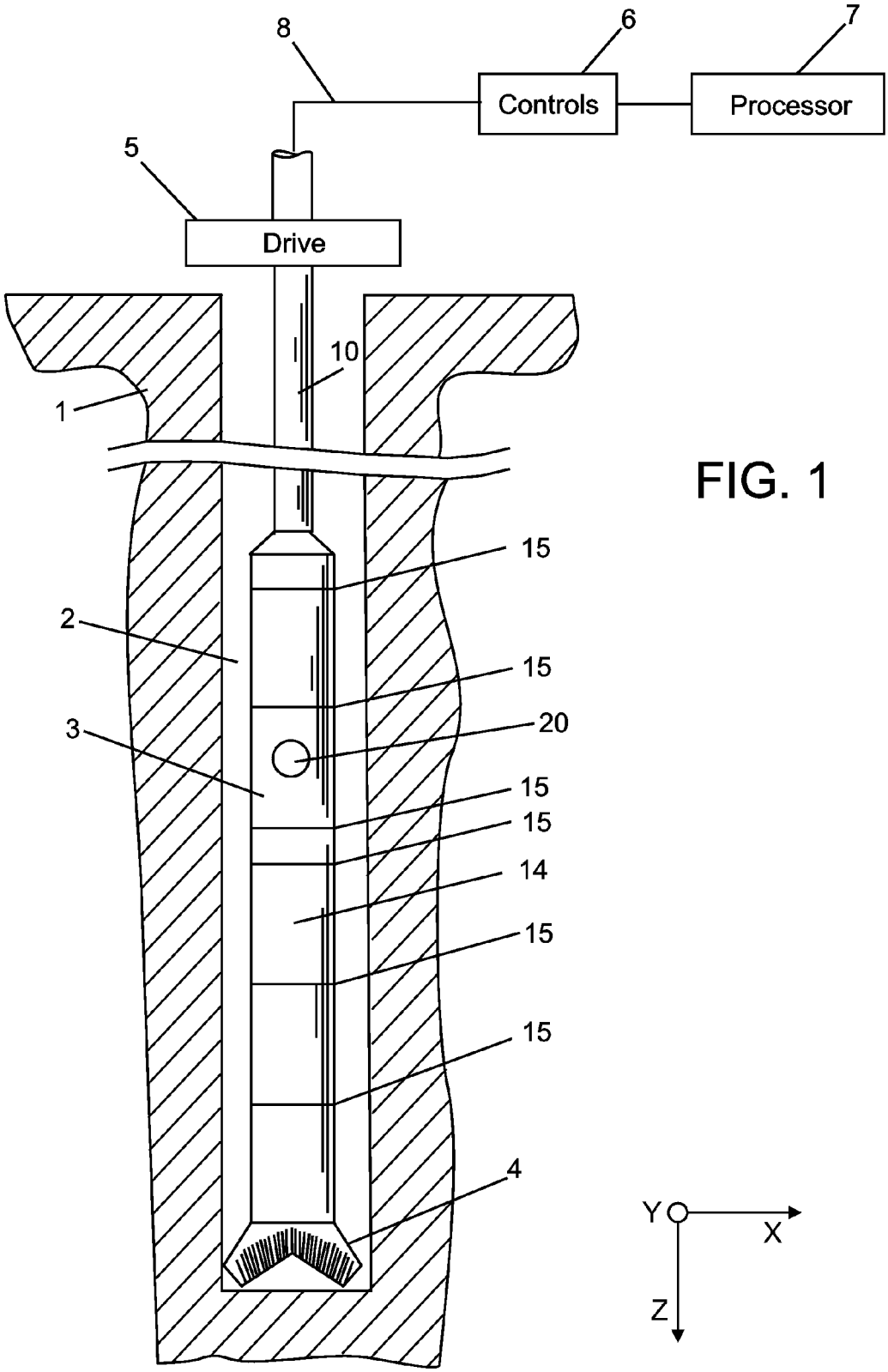
FIG. 1 depicts aspects of a drill string for drilling into earth formations.

Referring now to FIG. 1, there are shown aspects of an exemplary embodiment of a tool 3 for drilling a wellbore 2 (also referred to as a "borehole", and simply as a "well"). The tool 3 is included within a drill string 10 that includes a drill bit 4. The drill string 10 provides for drilling of the wellbore 2 into earth formations 1. The drill bit 4 is attached to a drill collar 14, each portion of the drill collar 14 being coupled at a coupling 15.

As a matter of convention herein and for purposes of illustration only, the tool 3 is shown as traveling along a Z-axis, while a cross section of the tool 3 is realized along an X-axis and a Y-axis. Accordingly, it is considered that each well may be described by spatial information in a coordinate system, such as the Cartesian coordinate system shown in FIG. 1.

The spatial information may include a variety of locational, positional and other type of coordinate information. For example, and without limitation, the spatial information may describe a trajectory of at least one of the wells, a diameter of a respective wellbore 2, a relationship between the object well and the reference well, and other such information.

A drive 5 is included and provides for rotating the drill string 10 and may include apparatus for providing depth control. Generally, control of the drive 5 and the tool 3 is achieved by operation of controls 6 and a processor 7 coupled to the drill string 10. The controls 6 and the processor 7 may provide for further capabilities. For example, the controls 6 may be used to power and operate sensors (such as an antenna) of the tool 3, while the processor 7 receives and at least one of packages, transmits and analyzes data provided by the tool 3.

Included with the tool 3 (in this case, embedded into the tool 3), is a friction sensor 20. Generally, the sensor 20 is placed in a location or area of the tool 3 that is selected for being subjected to at least one of extreme localized friction and average amount of friction (i.e., representative amounts of friction over the drill string).

In general, the sensor 20 (also referred to as a "friction sensing element" 20) detects an amount of friction as cuttings or a swelling formation 1 come into more firm contact with the drill string, such as along a tubular portion of the drill string 10 where the sensor 20 may be installed.

Various embodiments of friction sensing systems may be employed, where at least one sensor 20 is used. For example, in one embodiment, if the drill string 10 is rotated, one friction sensor can indicate the portion of the circumference that is in frictional contact. In horizontal drilling, the cuttings tend to settle on the low side of the borehole due to gravity. When more and more cuttings accumulate, more and more of the outer circumference of the drill string comes into contact with the environment, increasing the friction. According to the disclosed method, this is detected by the friction sensor 20. In order to gain such information for more than one location on the Z-axis, it may be beneficial to have more than one friction sensor 20 along the drill string 10.

As an example, wired drill pipe may be used to place a plurality of sensors 20 into repeater subs along the drill string 10. Users may then gain direct knowledge about the quality of hole cleaning and stability of the wellbore 2 along the complete well path. FIG. 2 shows an embodiment of the sensor 20 mounted into a pocket milled into the side of a drilling collar 14, and held in place by a threaded retaining cap 22 as a retention device for keeping the sensor 20 mounted in place. A more complete illustration of an exemplary embodiment of the sensor 20 is provided in FIG. 3.

Figure 3:
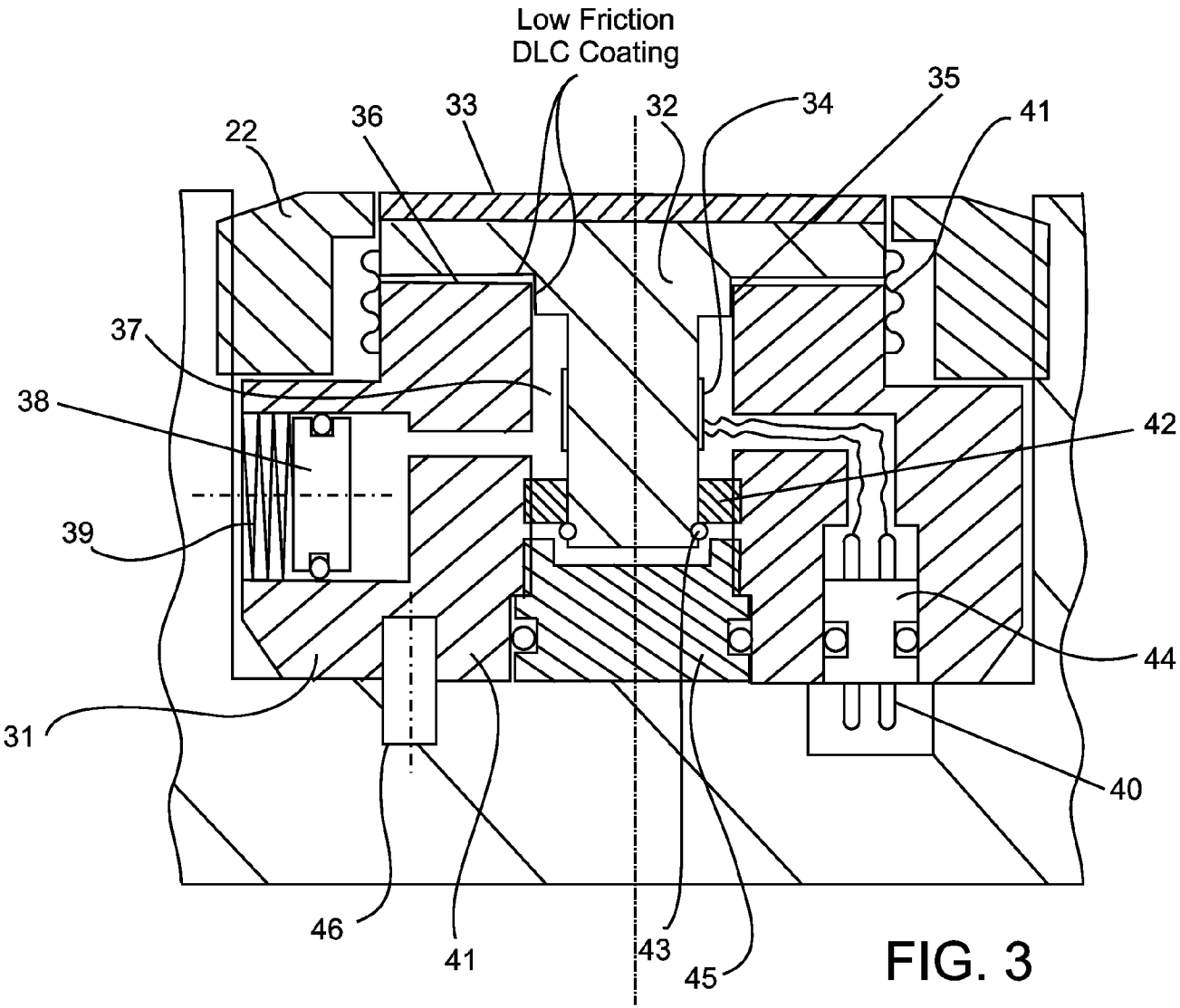
FIG. 3 depicts the friction sensor of FIG. 2 in greater detail.
Figure 4A:
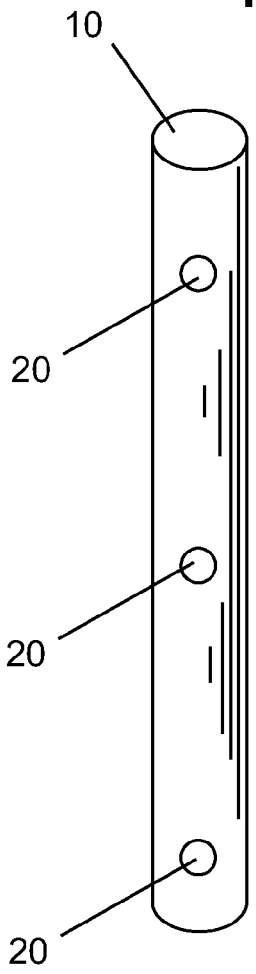
FIG. 4A and FIG. 4B, collectively referred to herein as FIG. 4, depict embodiments of a friction monitoring system deploying multiple sensors.
Figure 4A:
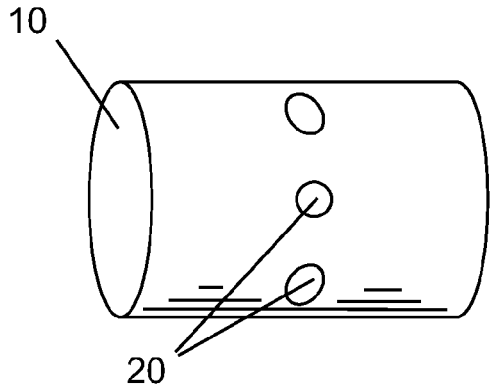
Figure 4B:
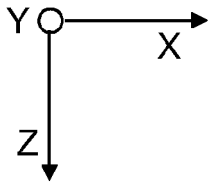
Figure 4B:
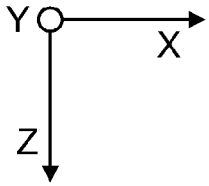

As shown in FIG. 3, the sensor 20 is generally built around a sensor body 31. The sensor body 31 may be formed of a variety of materials. In one example, non-magnetic steel is used. The sensor body 31 generally includes a sensor element 32. The sensor element 32 may be formed of a variety of materials. In one example, titanium is used.

In the embodiment depicted, the sensor element 32 has an outer surface which is flush with the outer surface of the drilling collar 14. The surface is coated with a hardfacing 33 in order to prevent premature wear. Frictional forces on the outer surface of the sensor element 32 will move the outer portion of the element 32, bending the inner section. The resulting bending strain is measured, using, for example, strain gages 34. Higher frictional forces create higher strain. The strain gages 34 are arranged such that signals from bending strains are amplified, while signals from axial strain in the sensor element 32 are compensated. This ensures that varying hydrostatic pressure and contact forces on the outer surface are not seen as noise in the sensor signals. In order to limit the possible deflection of the bending section, an overload shoulder 35 in the sensor body 31 is provided. The polygon shape (not shown) of the overload shoulder 35 provides rotational support to the sensor element 32, preventing it from being twisted. The sensing element 32 is preloaded against the sensor body 31 by a preloading disc 42. This protects the sensor element 32 from vibration damage and retains it inside the sensor body 31. Impacts onto the outer surface are absorbed by a strong ring contact area 36 between the outer part of the sensor element 32 and the sensor body 31. This ring contact area 36 and the overload shoulder 35 are coated with a low friction coating (e.g. a Diamond Like Carbon (DLC) coating or a polytetrafluorethylene (PTFE) coating (such as Teflon™ by DuPont)). Such coatings have very low coefficients of friction and deflection of the sensor element 32 is therefore primarily indicative of external frictional forces. The complete internal volume of the sensor is filled with a fluid 37 (e.g. with a non conductive oil). The fluid 37, in conjunction with a compensation piston 38, driven by a piston spring 39, provides a generally balanced pressure around the sensor element 32. The fluid 37 additionally lubricates the contact areas 35, 36, driving down the internal friction of the sensor 20. A fluid seal between the sensor element 32 and the sensor body 31 is provided by a membrane 41, preferably made of metal, in order to ensure a highly reliable seal as well as low seal friction. The metal membrane is preferably laser or electron beam welded to the other members. Other components, as shown in FIG. 3, may be included, such as a threaded pre-loading disc 42, a snap ring 43, a pressure bulkhead 44, a sealing plug 45 and an anti-rotation pin 46.

In general, the strain gages 34 include an electrical output 40, such as may be used for coupling to an electronics unit. Generally, a processor is used for processing data from the sensor 20. The electronics unit itself is not shown, as such units are common elements of downhole tools and hence need no further description.

Pressure compensation could be achieved by methods other than a compensation piston. For example, pressure compensation could be achieved by use of a rubber bellow, a rubber membrane, a metal bellow or a metal membrane. The sensor 20 could be rubber encapsulated instead of oil filled, thus eliminating some of the parts shown in FIG. 3. The sensor 20 could be retained in the collar 14 in many different ways. The forces acting on the sensor element 32 could be measured by other means than strain gages 34 (e.g. by piezo force sensors). It could be the deflection of the sensing member as a distance which is measured, rather than the bending moment. All distance measurement principles could in this embodiment be applied (e.g. capacitive sensing or ultrasonic sensing). In short, in various embodiments, the sensor 20 includes components for converting mechanical stress arising from friction between the tool 3 and the surrounding formation 1 into an electrical signal.

Referring now to FIG. 4, there are shown various embodiments of a system deploying a plurality of sensors for monitoring friction. In FIG. 4A, the sensors 20 are arranged to monitor friction along a length of the drill string 10 (e.g., as a function of depth). In FIG. 4B, the sensors 20 are arranged to monitor friction along a circumference of the drill string 10 (e.g., as a function of filling of the wellbore with cuttings during lateral drilling). Of course, various other arrangements, or combinations thereof, may be had.

Using friction monitoring systems having a plurality of sensors 20 provides certain advantages. For example, redundant sensors 20 will provide more reliable data. Use of strategically located sensors 20 can provide for estimation of an extent of high friction conditions. In some embodiments, it is possible to estimate a burden of drill cuttings within the wellbore 2.

Figure 5:
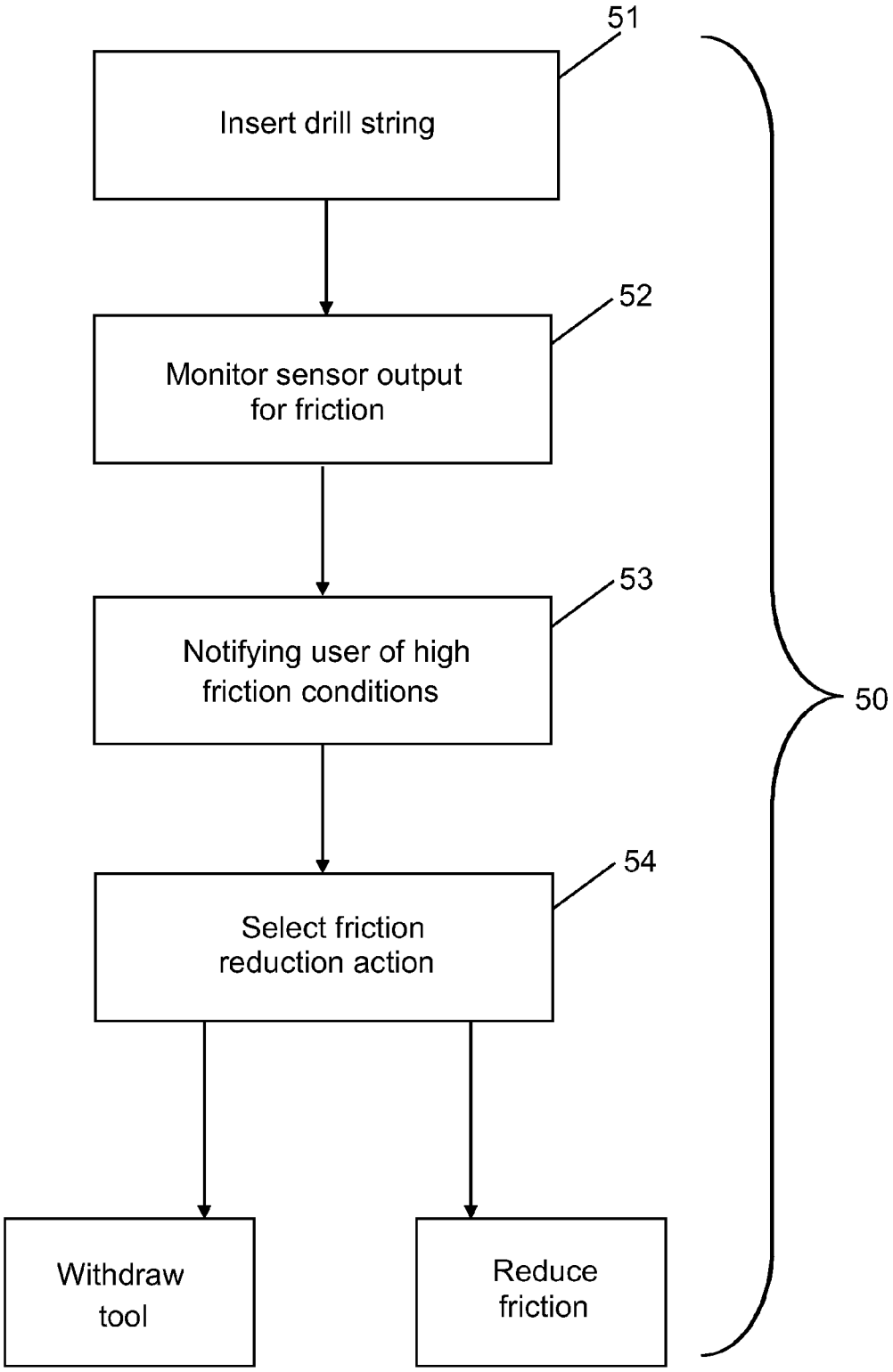
FIG. 5 is a flow chart providing an exemplary method for use of the sensor.

Referring now to FIG. 5, there is shown a flow chart providing an exemplary method for limiting exposure of a drill string 10 to friction. The method for monitoring 50 includes: in a first stage 51 inserting the drill string 10 that includes at least one sensor 20 into a wellbore 2; in a second stage 52, monitoring the at least one sensor 20; in a third stage 53, notifying a user of a high friction condition; and, in a fourth stage 54, selecting an alternative friction reducing action by one of removing the drill string 10 and reducing the friction (such as by increasing pumping of cuttings from the wellbore 2).

In support of the teachings herein, various analysis components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), a motive force (such as a translational force, propulsional force or a rotational force), a magnet, an electromagnet, a sensor, a controller, an optical unit, an electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for preventing a downhole tool from getting stuck in a wellbore, the method comprising:

monitoring an output of at least one friction sensing device including a friction receiving portion having a base and an extended portion extending from the base, the base having an outer surface flush with an outer surface of the downhole tool, and the extended portion having a sensor located on an outer radial side of the extended portion to detect a characteristic of a radially-facing surface of the extended portion, the output of the at least one friction sensing device including an output of the sensor; and reducing the friction to prevent the tool from getting stuck based on determining that the output indicates a high-friction condition.

2. The method as in claim 1, wherein reducing the friction comprises at least partially withdrawing the downhole tool from the wellbore.

3. The method as in claim 1, wherein reducing the friction comprises removing at least a portion of friction producing components in the wellbore.

4. The method as in claim 3, wherein the friction producing components comprise at least one of drilling mud and drill cuttings.

5. A tool for use in a wellbore, comprising:

a main body having an outer surface; and at least one friction sensing device comprising a friction receiving portion including a base and an extended portion extending inwardly from the base, the base having an outer surface flush with the outer surface of the tool, and the extended portion having a sensor located on an outer radial side of the extended portion, the sensor configured to detect a characteristic of a radially-facing surface of the extended portion.

6. The tool as in claim 5, wherein the sensor is a strain gage.

7. The tool as in claim 5, wherein the friction sensing device is mounted to a drill collar of a drill string.

8. The tool as in claim 5, comprising wired drill pipe.

9. The tool as in claim 5, wherein the outer surface of the friction receiving portion comprises a hardfacing.

10. The tool as in claim 5, wherein the base extends lengthwise along the outer surface of the tool and the extended portion extends from the base into the tool.

11. The tool as in claim 10, wherein the friction sensing device includes a retaining body to retain the friction receiving portion therein, and a fluid fills spaces between the extended portion and the retaining body.

12. The tool as in claim 11, further comprising a membrane connecting ends of the base and the retaining body, the fluid being contained by the membrane.

13. The tool as in claim 11, wherein the friction sensing device comprises a coating on at least a portion of the extended portion that reduces internal friction between the extended portion and the retaining body.

14. The tool as in claim 13, wherein the friction reducing coating is at least one of: a carbon coating, a diamond coating and a polytetrafluorethylene (PTFE) coating.

15. The tool as in claim 11, further comprising:

a protrusion between the base and the extended portion to contact the retaining body; and a disk between the extended portion and the retaining body, wherein the friction receiving portion is retained in the retaining body by the protrusion and the disk.

16. The tool as in claim 10, further comprising a disk between the extended portion and the retaining body.

17. The tool as in claim 10, wherein the friction receiving portion is shaped substantially as a "T", the base being a top of the "T" and the extended portion being a trunk of the "T".

18. The tool as in claim 5, wherein the sensor comprises a piezo force sensor.

19. The tool as in claim 5, wherein the sensor is a distance measuring device.

20. The tool as in claim 19, wherein the distance measuring device is at least one of: an ultrasonic transducer, a capacitive sensing device and a potentiometer.

21. A computer program product comprising machine readable instructions stored on machine readable media, the instructions for notifying a user of friction on a downhole tool, by implementing a method comprising:

receiving output from at least one friction sensing device a base and an extended portion extending from the base into the downhole tool, the base including a friction receiving portion having an outer surface flush with an outer surface of the downhole tool, and the extended portion including a sensor located on an outer radial side of the extended portion to detect a characteristic of a radially-facing surface of the extended portion, the output of the at least one friction sensing device including an output of the sensor; and notifying the user of the friction sensed.

22. The computer program product as in claim 21, further comprising instructions for determining if friction sensed by the at least one friction sensor exceeds a threshold value.

23. A friction sensing device, comprising:

a retaining body;

a friction receiving portion retained by the retaining body, the friction receiving portion comprising a base having an outer surface facing out from the retaining body to receive friction and an extended portion extending into the retaining body from the outer surface; and a sensor located within the retaining body to detect characteristics of an outer radially-facing surface of the extended portion to sense friction on the outer surface of the base.

* * * * *